United States Patent [19]

Weyer

[11] 4,204,189

[45] May 20, 1980

[54] SYSTEM FOR LONG DISTANCE TRANSMISSION OF SIGNALS IN BOTH DIRECTIONS

[75] Inventor: Reinhard Weyer, Munich, Fed. Rep. of Germany

[73] Assignee: Siemens Aktiengesellschaft, Berlin & Munich, Fed. Rep. of Germany

[21] Appl. No.: 901,829

[22] Filed: May 1, 1978

Related U.S. Application Data

[63] Continuation-in-part of Ser. No. 599,488, Jul. 28, 1975, abandoned, which is a continuation of Ser. No. 395,052, Sep. 7, 1973, abandoned, which is a continuation of Ser. No. 213,019, Sep. 28, 1972, abandoned.

[30] Foreign Application Priority Data

Sep. 8, 1972 [DE] Fed. Rep. of Germany ..... 2244173

[51] Int. Cl.[2] ..... G08G 1/07

[52] U.S. Cl. ..... 340/40; 370/77

[58] Field of Search ..... 179/2 DP, 15 R, 15 FD, 179/15 A, 3; 340/40, 41 R, 35

[56] References Cited

U.S. PATENT DOCUMENTS

| | | | |
|---|---|---|---|
| 3,079,587 | 2/1963 | Barker | 340/35 |
| 3,175,193 | 3/1965 | Willyard | 340/35 |
| 3,375,494 | 3/1968 | Piening | 328/48 |
| 3,544,976 | 12/1970 | Collins | 179/15 AL |
| 3,764,972 | 10/1973 | Siklos | 340/35 |

OTHER PUBLICATIONS

IBM Technical Disclosure Bulletin; vol. 7, No. 3; Aug. 1964; "Traffic Controller Tone Multiplexing System" by M. Druckerman.

*Primary Examiner*—David L. Stewart

*Attorney, Agent, or Firm*—Hill, Van Santen, Steadman, Chiara & Simpson

[57] ABSTRACT

A time multiplex long distance transmission system for transmitting signals in both directions, particularly for street traffic signaling systems, utilizes a single timing generator which transmits a time slot pattern, preferably coded, to all stations by way of a few control channels, wherein existing information can be transmitted to the station by way of a respective further control channel for the station.

3 Claims, 10 Drawing Figures

Fig. 3

| Code | $Se^1 Se^2 Se^3 Se^4$ | Zr | S11(S21) | BF(MD) | |
|---|---|---|---|---|---|
| 1. | 0 0 0 0 | | | | |
| 2. | 1 0 0 0 | | | | |
| 3. | 0 1 0 0 | | | | |
| 4. | 1 1 0 0 | 0÷1/6 sec | 0 1 | BF1 (MD1) | $2^6$ Code |
| 5. | 0 0 1 0 | | | | |
| 6. | 1 0 1 0 | 1/6÷2/6 sec | 0 1 | BF2 (MD2) | |
| 7. | 0 1 1 0 | 2/6÷3/6 sec | 0 1 | BF3 (MD3) | |
| 8. | 1 1 1 0 | | | | |
| 9. | 0 0 0 1 | | | | |
| 10. | 1 0 0 1 | 3/6÷4/6 sec | 0 1 | BF4 (MD4) | |
| 11. | 0 1 0 1 | 4/6÷5/6 sec | 0 1 | BF5 (MD5) | |
| 12. | 1 1 0 1 | | | | |
| 13. | 0 0 1 1 | 5/6÷ 1 sec | 0 1 | + BF6 / BFü (MD5) | |
| 14. | 1 0 1 1 | | | | |
| 15. | 0 1 1 1 | | | | |
| 16. | 1 1 1 1 | | | | |

SYSTEM FOR LONG DISTANCE TRANSMISSION OF SIGNALS IN BOTH DIRECTIONS

CROSS REFERENCE TO RELATED APPLICATION

This application is a continuation in part of Ser. No. 599,488 filed Jul. 28, 1975, abandoned; which is a continuation of Ser. No. 395,052, filed Sept. 7, 1973, abandoned: which is a continuation of Ser. No. 213,019, filed Sept. 28, 1972, abandoned.

BACKGROUND OF THE INVENTION

1. Field of the Invention

This invention relates to a system for long distance transmission of signals in both directions, particularly for street traffic signaling systems which operate on a time multiplex basis.

2. Description of the Prior Art

My earlier application, Ser. No. 293,019, was directed to such a system for street traffic signaling which, in particular, utilized pulse trains whose digit values could be fixed by timers and synchronizing pulses by way of a control channel. As explained in that application, with conventional time division multiplex methods, a timer is started at each receiving location by a starting or synchronizing pulse, and is thus turned with the timer in a main station. It is therefore possible to apply pulse trains for the transmission of signals from the main station to the individual receiving stations, and from the receiving stations to the main station. However, in order to provide time multiplex transmission functions in an orderly manner, the timer in the receiving station must be accurately synchronized with the timer in the main station and, in particular, the individual widths of the pulses may not change in order to avoid mistakes during transmission. With the increasing usage of computers in the main station, for example, the required pulse train for transmission of control signals can advantageously be obtained from the outputs of such computers. The transmission speed of the individual pulse trains in the computers is extremely high so that the long distance transmission systems which usually operate slowly can therefore be simply operated. However, there still exist the possibility that the computer has not completed its program and that the individual pulses cannot be transmitted at the correct pulse rate.

As mentioned above, in a conventional time multiplex method, a timer is started or synchronized at each receiver by a starting or synchronizing pulse, and is therefore synchronized with the timer in the main or central station. It is therefore possible to transmit a plurality of signals from the central station to the individual stations, and from the individual stations to the central station by way of a few circuits or one single circuit. In addition to the possibility that a computer has not completed its program and cannot therefore emit the individual pulses at the correct rate, another drawback of the prior systems is the requirement for a large number of timers in the individual stations which renders the system more expensive and susceptible to interference.

SUMMARY OF THE INVENTION

It is therefore an object of the invention to provide a long distance transmission system which, on one hand, operates on a time multiplex basis so that a plurality of variable signals can be transmitted to different stations by way of a few circuits, but which, on the other hand, avoids the disadvantages which results from the expense connected with and the susceptibility to interference of a plurality of timers. In addition, the system shall take into account the differences corresponding to the particularities of the computers during the emission of the individual pulse sequences of the time slot pattern.

According to the invention, the foregoing object is achieved with such a system for long distance transmission of signals in both directions in that a single timer codes the time slot pattern by way of a few control channels, that such information is transmitted to all stations, and that by way of at least one further control channel for each station the adjacent signals can be transmitted to that station.

In a further embodiment of the invention, a time slot pattern can be transmitted by way of four control channels, e.g. by means of variable frequencies, in such a way that per predetermined interval time two of the control channels have equal values for the purpose of simple code monitoring. It is also advantageous when the control channels can be realized by different frequencies which are provided by way of a single telephone line. In a further development of the invention, the same control channels can be used for the time slot pattern transmission, but variable control channels for signals which can be transmitted in another direction for the outgoing and return transmission of signals.

BRIEF DESCRIPTION OF THE DRAWINGS

Other objects, features and advantages of the invention, its organization, construction and operation will be best understood from the following detailed description of a preferred embodiment of the invention taken in conjunction with the accompanying drawings, on which:

FIG. 3 is a compilation of a transmission code;

DESCRIPTION OF THE PREFERRED EMBODIMENTS

Figure 1:
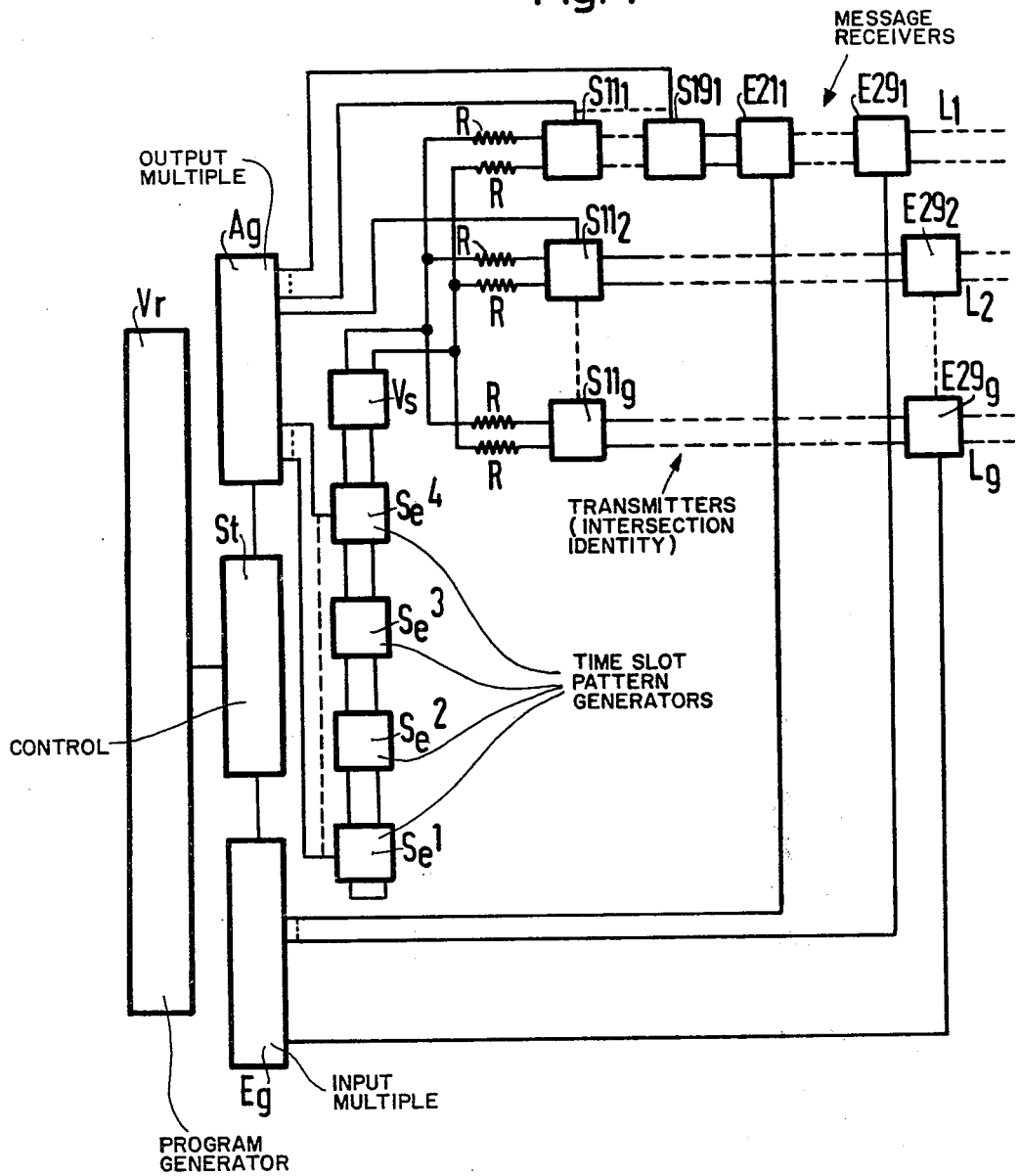
FIGS. 1 and 2 together form a schematic block diagram of a street traffic signaling system connected to a computer in a central station in accordance with the invention.
Figure 2:
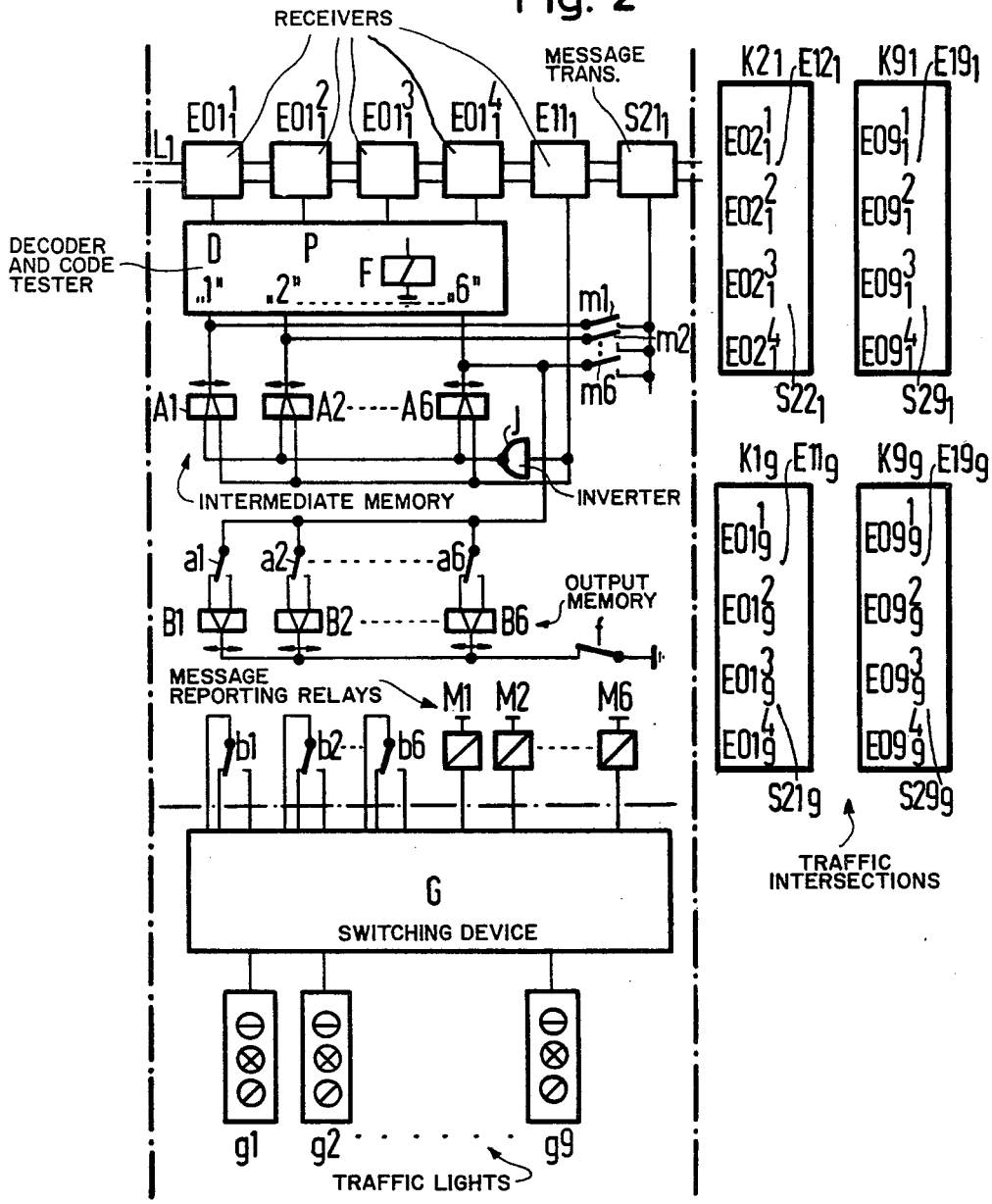

Referring to FIGS. 1 and 2, a central station Ze includes a traffic computer Vr as a program generator. The program generator Vr provides orders to the individual control channels of the transmission devices by way of a data control device St and an output multiple Ag. The signal generators gl . . . g9 of the individual intersections $K1_1$. . . $K9_9$ of the system are therefore controlled by the control channel. These provide condition messages to the traffic computer Vr by way of the control channels, an input multiple Eg and data control device St.

All switching elements which are required only once are designated in the switching arrangement by two letters, that is a capital and a small letter; for example the time slot pattern is formed by the generators $Se^1$ . . . $Se^4$. All remaining switching elements are designated only with a single letter. The letters are required at least in the amount which corresponds to the number of intersections K.

The generators $Se^1$ . . . $Se^4$ of the time slot pattern are connected to all circuits $L_1$ . . . $L_g$ of the system by way of an amplifier Vs and the resistors R and therefore together provide the time slot pattern to all decoding and code testing devices D and P, respectively, in the individual intersections $K1_1$ . . . $K9_9$ of the street traffic signaling system. The time slot pattern is therefore provided sequentially in a seconds cycle at the outputs "1" . . . "6" of the decoding device D.

Furthermore, the testing device P monitors the correct coding of the individual pulses of the time slot pattern along with the fault supervisory relay F and interrupts a transfer of the existing signals into the output memory B1 . . . B6, which function as will be explained below, when an incorrect transmission occurs, by means of the relay contact f. If during the first time slot an order, for example the order BF1 shall be transmitted to the intersection $Kn1_1$, the transmitter $S11_1$ must be switched on which corresponds to the intersection $Kn1_1$. An intermediate memory A1 is therefore operated by way of the receiver $E11_1$. Corresponding orders can therefore be provided to all of the intersections $K2_1$ . . . $K9_9$ of the system by way of the additional transmitters $S12_1$ . . . $S19_9$. During the second time slot, the order BF2, etc, is transmitted accordingly to the intersections $K1_1$. . . $K9_9$. All further intermediate memories A2 . . . A6 can therefore be adjusted eventually in all of the intersections K. If no order is transmitted from the aforementioned transmitters $S11_1$, etc, then the receivers $E11_1$ etc, in the individual intersections K do not provide an operating order to the corresponding intermediate memories A1 . . . A6 so that the latter are reset into their rest position by way of an inverter J. Simultaneously with the remainder of the time slot pattern, the contacts a1 . . . a6 receive voltage from the output "6" of the decoding device D and at the same time operate the output memories B1 . . . B6 into the position which corresponds to the orders BF1, etc, which have been transmitted last. The orders BF1 . . . BF6, which are transmitted in series are therefore provided in parallel to the switching device G of the intersection $K1_1$, and the signal generators gl . . . g9 are therefore switched synchronously. However, this occurs only when the code testing device P does not detect fault and the fault supervisory relay F does not open its series connected contact f. Such action would otherwise prevent the switching of the output memory B1 . . . B6.

The orderly functioning of the device G and its respective operating cycle is examined in the device at the intersection $K1_1$ and is reported back to the central station Ze by way of the reporting relays M1 . . . M6. The message reporting relays and their contacts are denoted as follows:

M1, m1-interference

M2, m2-device G operates through the central station Ze

M3, m3-device G operates according to its own program and

M4, m4-device operates dependent upon traffic.

The relays M1 . . . M6 therefore switch the transmitter $S21_1$ on with their respective contacts m1 . . . m6 each time during the individual time slots "1" . . . "6", the transmitter $S21_1$ providing the above messages to the traffic computer Vr by way of the receiver $E21_1$.

FIG. 3 illustrates the code with which the four transmitters $Se^1$ . . . $Se^4$ produce the time slot pattern and with the help of the latter the generators S11 and S21, respectively, are then able to transmit the orders BF and the messages MD, respectively, altogether, six orders BF1 . . . BF6 and one transfer order BFu can therefore be transmitted in the present case to an intersection $K1_1$ by the central station Ze. With these orders BF1, etc, the corresponding signal generators g1 . . . g9 are controlled in the intersection control device G. It is not always necessary for the orders BF1 . . . BF6 to be fed synchronously into the control device G. However, if individual orders contradict each other—if for example the order BF1 of the one direction and BF3 of the opposite direction would clear the line—the synchronous transfer of all orders must be guaranteed by the transfer order BFu. Furthermore, also the six orders BF1 . . . BF6 can be combined into a single code, and altogether $2^6$ orders can be applied in the switching device G of an intersection K.

Furthermore, it can be seen from the compilation of the transmission code for the time slot pattern that only six of the sixteen possibilities are exploited, that is expecially those whereby always two transmitters $Se^1$ . . . $Se^4$ are switched on and the two other transmitters are switched off. The codes to be considered are underlined in FIG. 3. A very simple code monitoring is obtained by this limitation of the code utilization because always the same number of receivers, for example $EO1^1$ . . . $EO4^4$ must be switched on or switched off, respectively, for a transmission period.

Figure 4:
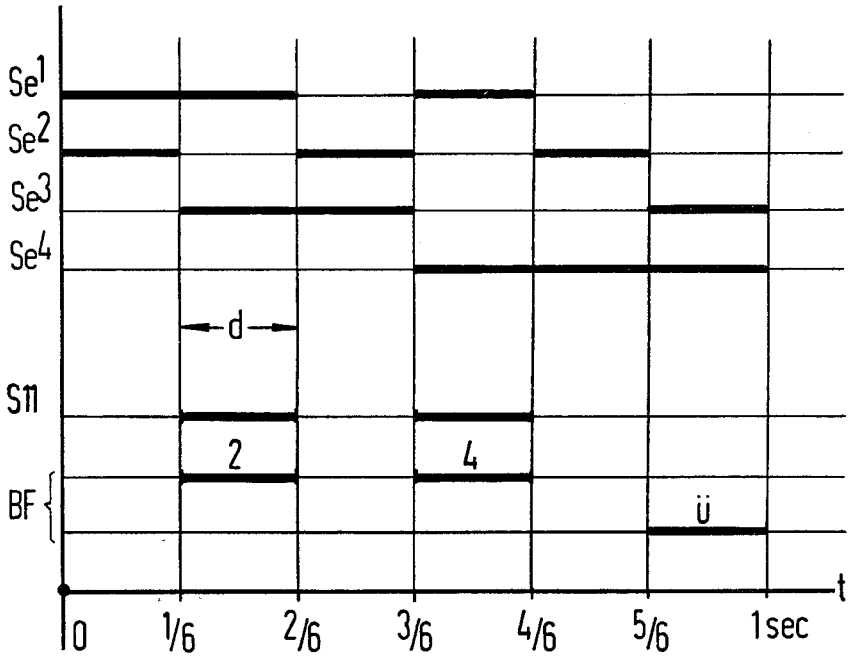
FIG. 4 is a transmission diagram.

In FIG. 4 the individual intervals of the time slot pattern "1" . . . "6" are illustrated. The transmitter S11 emits the order BF2 and BF4 during the second and the fourth time slot intervals. The last interval of the time slot pattern finally provides the transfer order BFu. Furthermore, the duration of the second interval is designated by the reference character d. It is therefore expressed that the duration of the time slot interval and the transmitting duration of the transmitter S11 are chosen to be equal. Changes of the length d of the time interval does not cause faulty signal transmission if the transmitting time of the transmitter S11 changes correspondingly. The duration of the time slot interval can therefore "breath" within certain limits according to the requirements of the computer.

In the present illustration swtiches were illustrated as relays and memories as bistable relays. Of course, the invention is not to be limited to this particular exemplary embodiment, rather each electronic or other solution which can be obtained by various control means is to be included within the spirit of the invention. As one skilled in the art will readily understand, many types of transistors and flip-flop circuits producible therefrom may be utilized, and magnetic core memories, flip-flops, shift registers and other devices may be employed for the memories.

For a better understanding of the present invention, one may take reference to British Pat. Nos. 1,054,199; 1,110,205; 1,156,521; 1,187,718; and 1,110,206, and to U.S. Pat. No. 3,375,494, all of which are concerned with traffic control computing operations. Referring specifically to U.S. Pat. No. 3,375,494, the transmission system of the present invention may be interposed between the contacts s1, s2 and the signal generators Sg1, Sg2. The left hand part of FIG. 2 of this patent therefore generally corresponds to the traffic computer Vr and the signal generators Sg1, Sg2 generally correspond to the signal generators g1 to g9 in FIG. 2 of the instant application. The United States and British Letters Patent are therefore incorporated herein by this reference to aid those skilled in the art in practicing the present invention.

Figure 5:
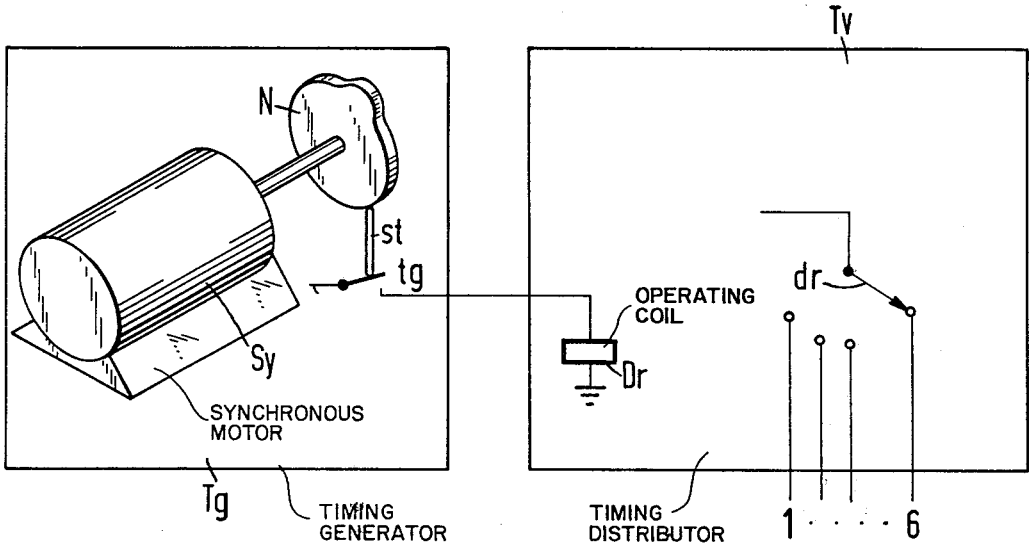
FIG. 5 is a schematic illustration of a timing generator for operating a timing distributor.

Referring now to FIG. 5, a timing generator Tg comprises a synchronous motor Sy which closes a timing generator switch tg every 1/6 of a second by way of a cam disc N and a cam follower st to operate a timing distributor Tv. The timing distributor Tv includes an operating coil Dr which operates a stepping contact dr. During operation of the timing distributor Dv, each time, for a duration of 1/6 of a second, voltage occurs sequentially at the outputs 1–6.

Figure 6:
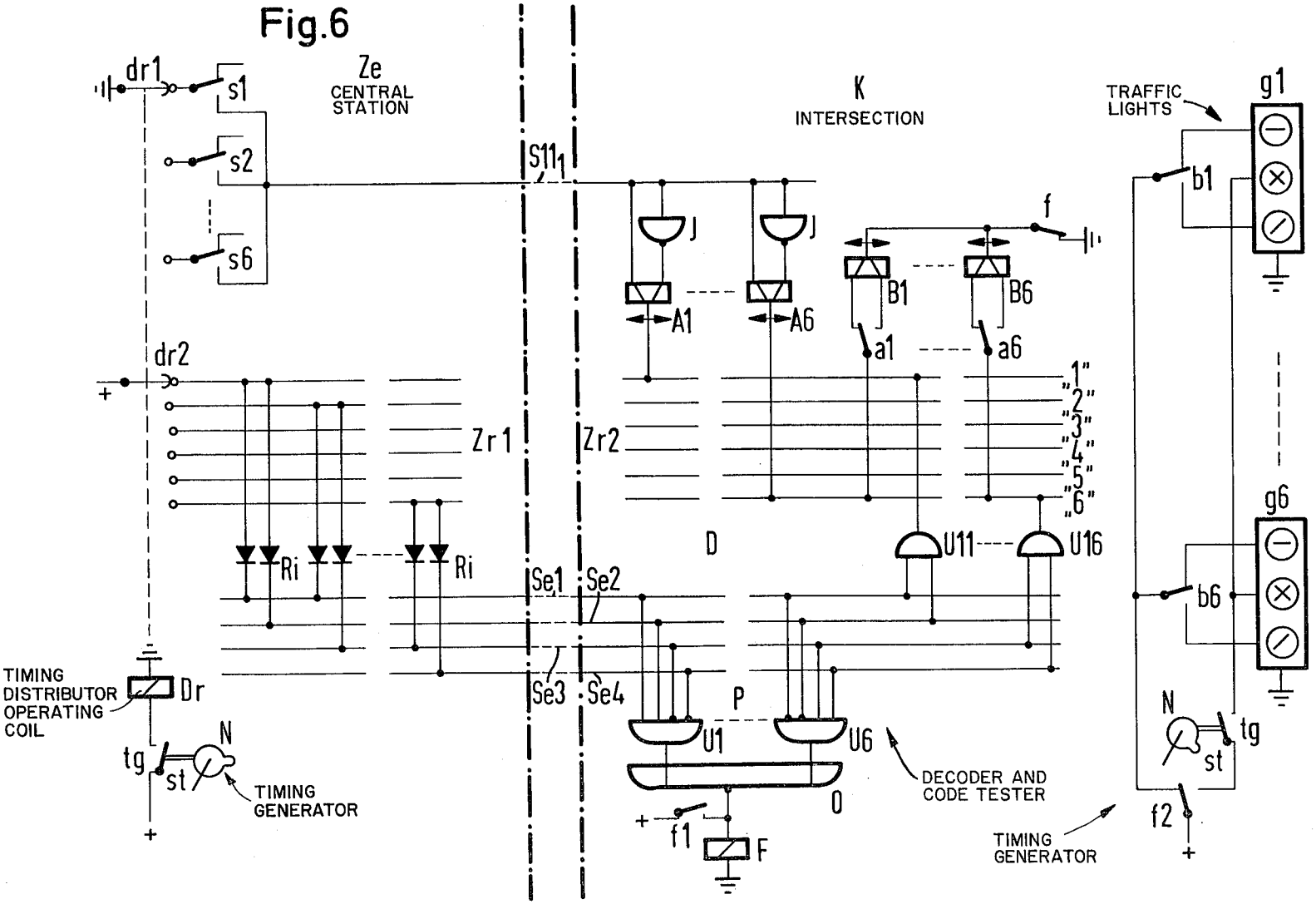
FIG. 6 is a schematic circuit diagram of a timing distributor.

The timing distributor Tv is illustrated in simplified form in FIG. 6. Its outputs are connected to a plurality of switches s1 to s6 as could be taken from FIG. 2 of U.S. Pat. No. 3,375, 494 and a time slot pattern Zr1. The transmitters $Se^1$ . . . $Se^4$, which are illustrated only as circuits, are supplied with voltage according to FIG. 4 by the time slot pattern Zr1 by way of rectifiers Ri. These symbolic circuits $S11_1$ and $Se^1$–$Se^4$ transmit the switching orders from the central station Ze to the intersections K.

A plurality of AND gates U1 . . . U6 form the testing device P illustrated in FIG. 2. Each of these AND gates U1 . . . U6 is connected with four inputs to the four circuits (transmitters) $Se^1$ . . . $Se^4$ and each time two inputs are ignored. Therefore, as long as the transmission of the time slots occur in order, according to FIG. 4, one of the AND gates U1 . . . U6 will be opened and therefore will not permit actuation of the relay F by way of an OR gate O whose output will not permit a response by the relay F. Once a fault occurs in the transmission, the relay F receives voltage by way of the OR gate O, operates and hold itself by way of a holding contact f1 and switches off the long distance transmission. The contact f then prevents the transfer of orders from the intermediate memories A1 . . . A6 to the output memories B1 . . . B6.

Also, at the same time, the transfer contacts f2, f3 reverse positions. The contact f2 disconnects the stop and go lights in the signal generators g1 . . . g6 and switches on "yellow flashing", as provided by a set of cam operated contacts tg. Furthermore, the contact f3 switches off the reporting relay M2 and switches on the reporting relay M1 which provides an interference message to the central station Ze, as can be seen in FIG. 7.

A plurality of AND gates U11 . . . U16 transform the orders, by means of a respective coating, which orders are transmitted by the circuits $Se^1$ . . . $Se^4$, into the time sequence according to FIG. 4 in the time slot pattern Zr2. These orders are now utilized to operate the intermediate memories A1 . . . A6, as described above with reference to FIG. 2, and from the intermediate memories A1 . . . A6 the output memories B1 . . . B6 are operated. The output memories B1 . . . B6 then switch the signal generators g1 . . . g9.

The reporting or message relays M1 . . . M6, which can report back to the central station Ze the functional state of an intersection K by way of the message route $S21_1$ and the transmitters $Se^1$ . . . $Se^4$ are illustrated in FIG. 7. Only the time slot patterns Zr1, Zr2 of FIG. 6 are illustrated in FIG. 7 since the transmission occurs by way of the transmission lines $Se^1$ . . . $Se^4$which are illustrated in FIG. 6. If the intersection K is operated, for example, by the central station Ze, the transfer contact f3 maintains the relay M2 attracted and causes, via the AND gate U32, a delayed release relay M12 to respond to cause illumination of a lamp La2 in the central station Ze, the message have being transmitted that the intersection K operates through the central station Ze. If an interference occurs at the intersection K, the contact f3 reverses and causes the relay M1 to respond which causes initiation of the message "interference" by way of the AND gate U31, the relay M11 and a lamp La1. Therefore, altogether six messages can be reported back to the central station from the intersection.

Figure 7:
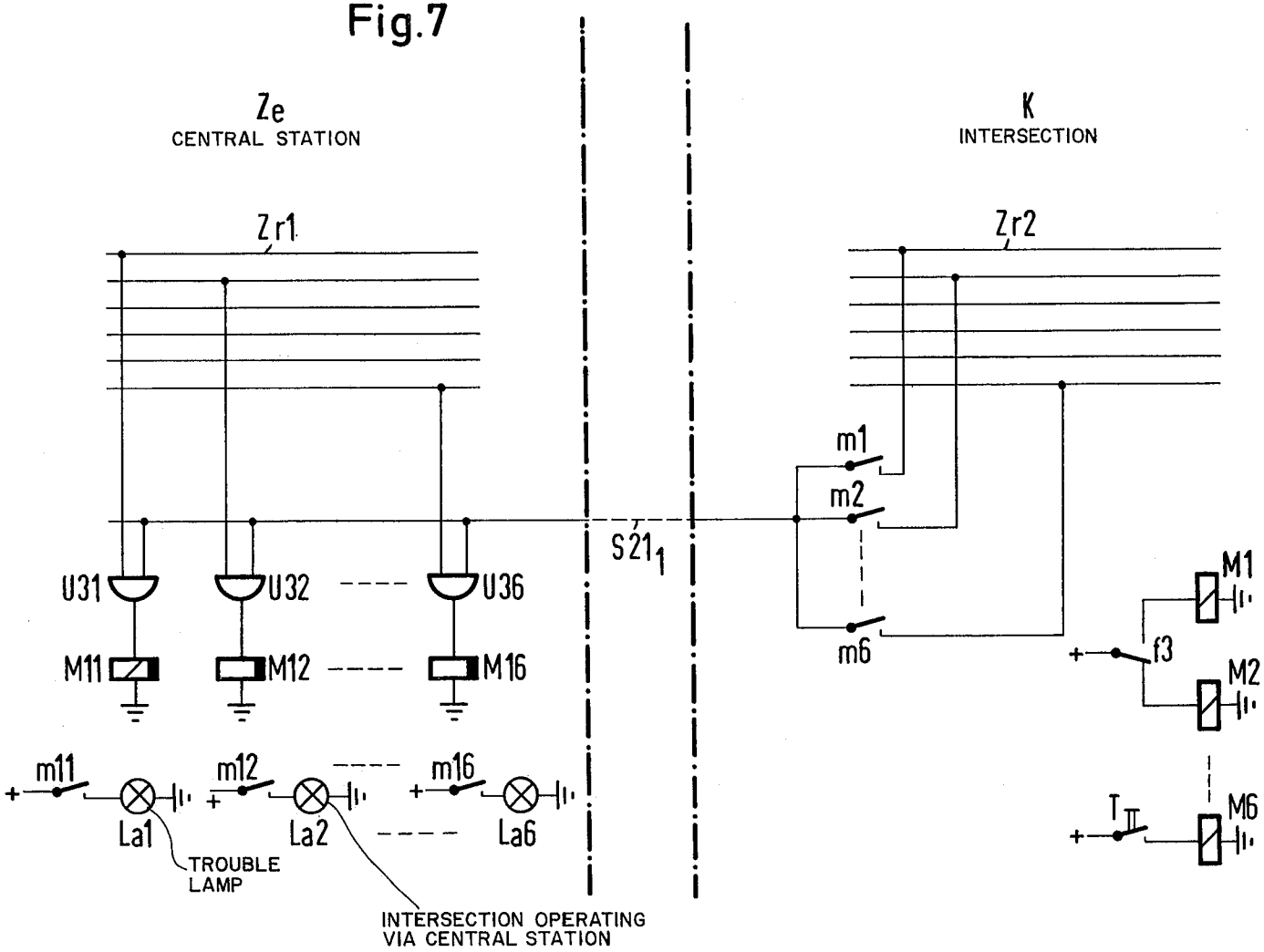
FIG. 7 is a schematic circuit diagram of relays for signaling toward a central station.

These possibilities which are described in FIGS. 5–7 are observed by the output and input multiples Ag, Eg in FIG. 1. These secure the connection from the traffic computer Vr to the actual transmission system. The data control device St is only concerned with the fact that the outgoing orders and the arriving messages can by processed successively by the traffic computer.

As mentioned above, all component parts can, of course, be constructed with modern electronic elements, relays and switches only having been referred to for a better explanation of FIGS. 5–7. Also, the transmission channels $S11_1$, $Se^1$ to $Se^4$ can be realized by a single circuit $L_1$ and were only drawn as separate circuits in FIGS. 6 and 7 for a simplified illustration.

As a brief summary of the foregoing, I have disclosed a device for remote transmission of signals in both directions, particularly for street traffic signaling systems, in which signals are exchanged in accordance with a time multiplex process which comprises the following features: a central station, a plurality of remote stations, a first group of transmission channels, which commonly connect the central station with all individual stations, a second group of additional individual transmission channels which, in each instance, individually connect the central station with a specified individual station, a device for producing a time slot pattern and for transmitting the time slot pattern by way of the first group of transmission channels to all individual stations, a device for producing control signals at specified stations within the time slot pattern for the purpose of transmitting these control signals by way of the additional individual transmission channels, as well as means for comparing the incoming control signals with the time slot pattern in the individual station, (or vice-versa producing a message of the individual station at a specific section of the time slot pattern, transmission of the message via the additional individual transmission channel from the individual station to the central station, and comparison of the incoming message signal in the central station with the time slot pattern).

Therefore, in accordance with the above, there are several possibilities including:

(a) transmission of control commands from the central station to the individual stations whereby the individual station is connected with the central station by a single additional individual transmission channel;

(b) transmission of messages from the individual station to the central station, whereby an individual transmission channel between the individual station and the central station is sufficient; and (c)transmission of commands from the central station to the individual station, and transmission of messages from the individual station to the central station, whereby the individual station is connected via two additional transmission channels with the central station.

In all three of the above possibilities, the number of common transmission channels for the time slot pattern is the same.

As many commands or messages, respectively, can be transmitted as there are sections in the time slot pattern. The type of command or message, respectively, is determined by the position of the signal in the time slot pattern. Therefore, if , as in the present example, the timing interval is subdivided into six sections, six different commands can be transmitted to each individual station.

The invention is not limited to a specific type of transmission channel. Therefore, it is possible to provide each transmission channel with its own line as indicated, by way of example, in FIG. 6. The signal could then be provided in the form of a direct current.

However, in general, it is more economical to provide a single line and to provide the transmission channels by different frequencies transmitted on the single line. Therefore, a transmission channel will be formed, in each instance, by means of a transmitter (e.g. $Se^1$–$Se^4$, $S11_1$, etc) of a specified frequency, and by means of a corresponding receiver (e.g. E01, E11, E21) at the other end of the line. The transmitters and receivers which are associated with each other are tuned to the same specific frequency and, in this manner, form a transmission channel.

Figure 8:
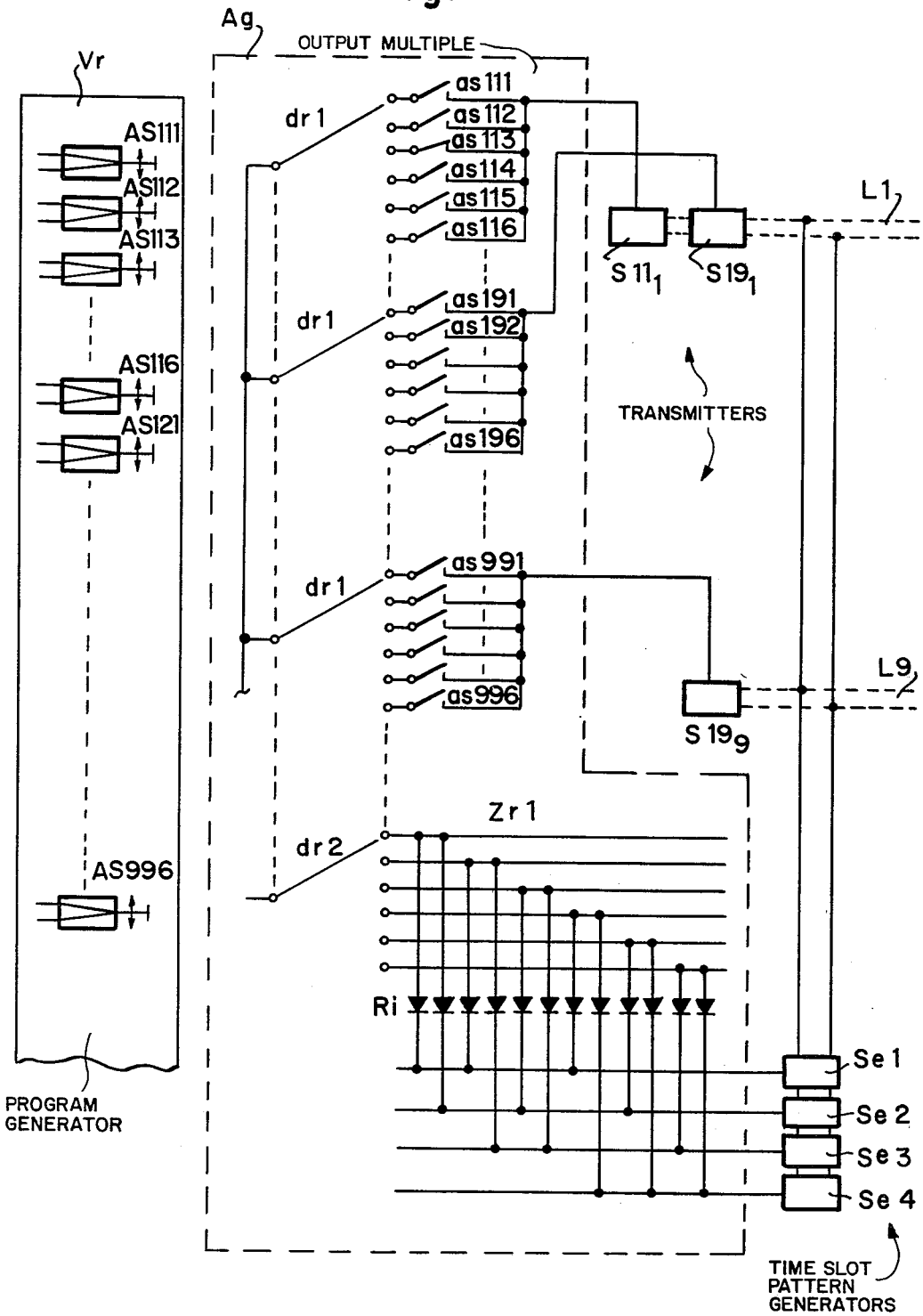
FIG. 8 is a schematic circuit diagram of one possible construction of an output multiple which may be employed in the structure of FIG. 1.
Figure 9:
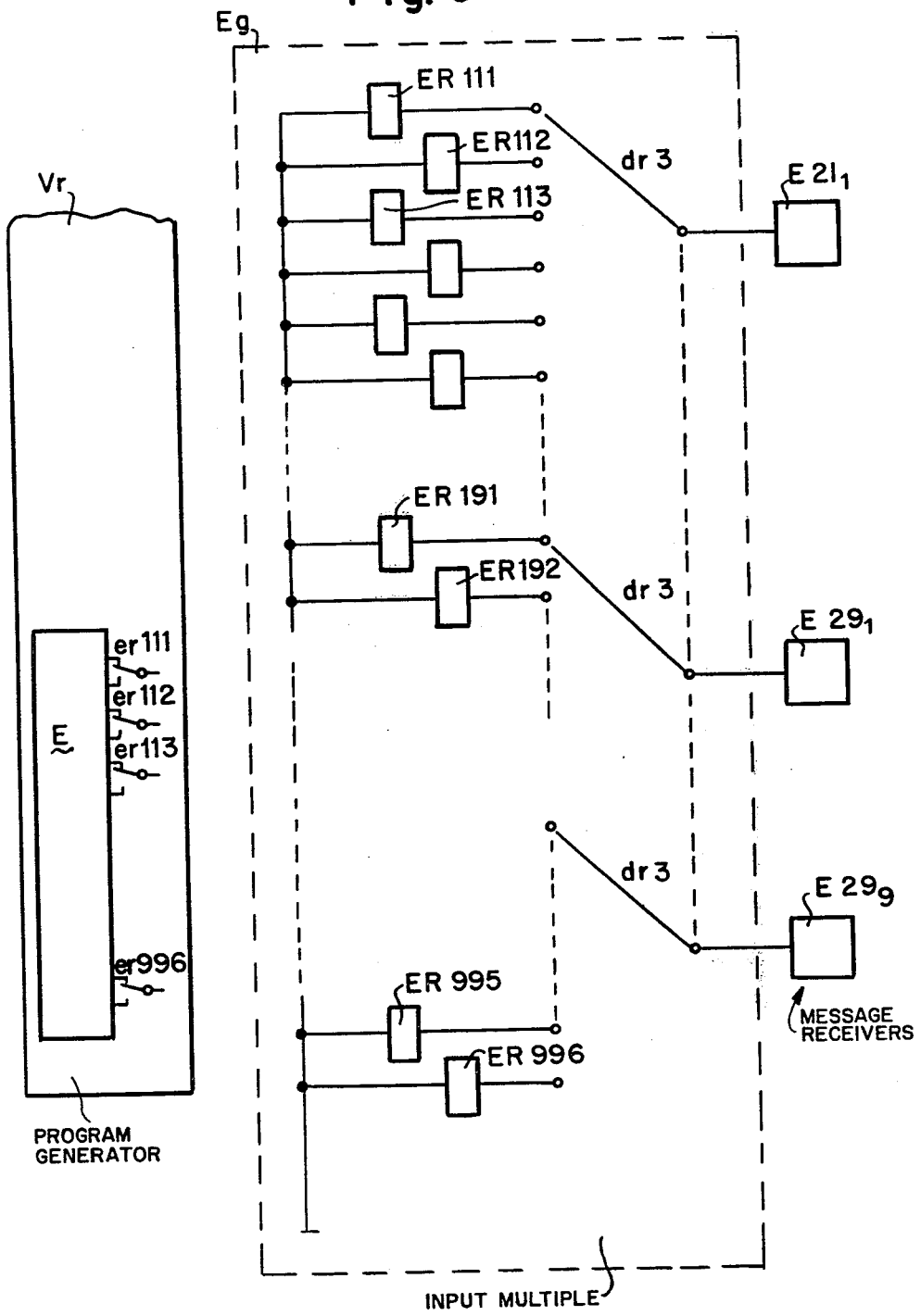
FIG. 9 is a schematic illustration of a possible construction of an input multiple which may also be used in the structure of FIG. 1.
Figure 10:
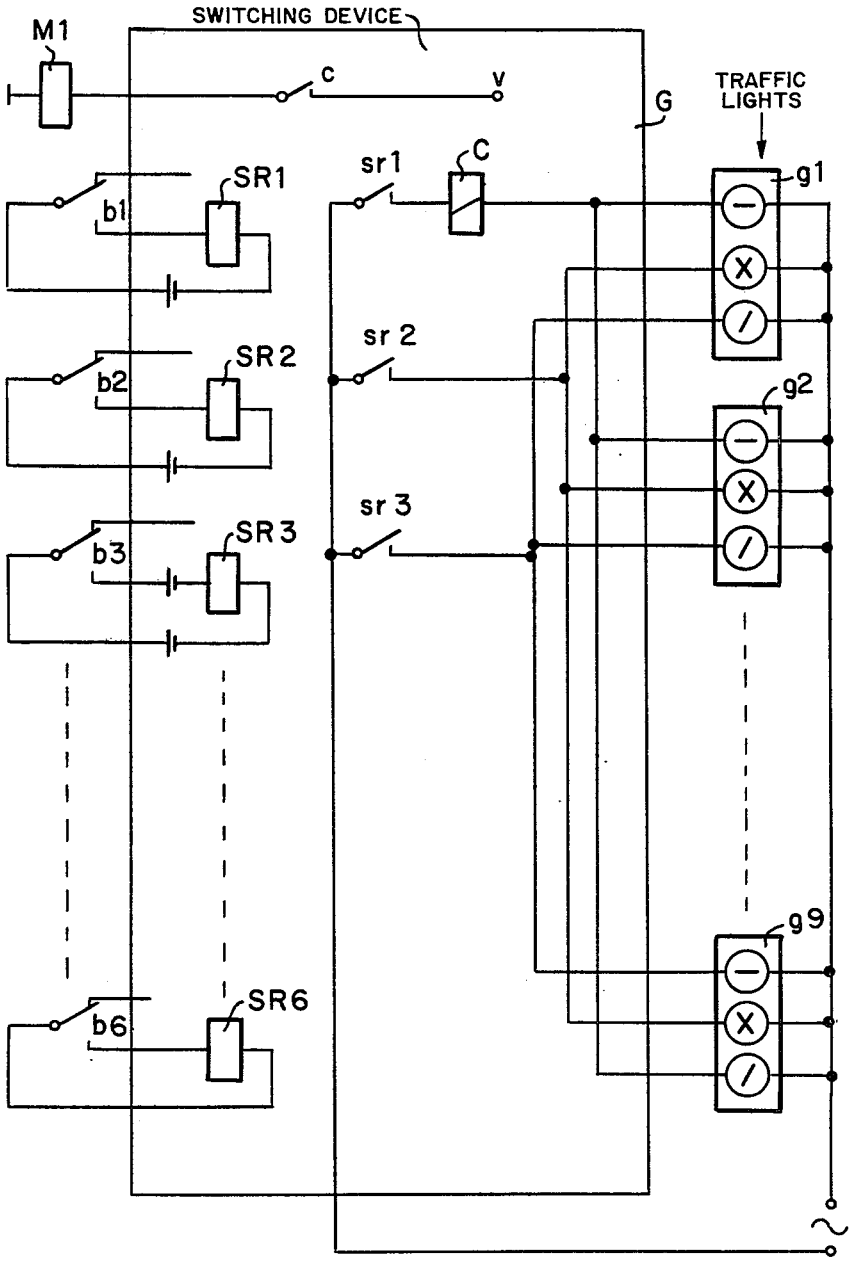
FIG. 10 is a schematic representation of a possible construction of a control installation of the type illustrated in FIG. 2.

In order to better understand the invention, one may refer to FIGS. 8, 9 and 10.

The traffic computer Vr is not actually a component of the invention; on the contrary, random commands and messages can be transmitted with this transmission system. However, if one assumes a traffic signal system, by way of example, the computer Vr is a conventional traffic computer, such as is disclosed in U.S. Pat. No. 3,375,494 (FIG. 2). This traffic computer has an output control unit Sch and an input unit E. In the present invention, these two parts cooperate together with the output multiple Ag and the input multiple Eg.

At the output of the traffic computer in U.S. Pat. No. 3,375,494, the command signals are represented by means of bistable components S1, S2, etc. and their contacts s1, s2, etc, directly connect the signal transmitters Sg1, Sg2, etc therein. The present invention is concerned with transmitting the switching state of these contacts over a greater distance to the traffic signals.

Referring to FIG. 8, and similar to the aforementioned computer, bistable elements AS111, AS112, etc, in the traffic computer Vr are illustrated, each of which represents a command by virtue of its switching state. If it is assumed that six different commands are possible for each interaction by virtue of the time slot pattern selected in the example, then the bistable elements AS111–AS116 belong to the intersection K11, and the corresponding additional bistable elements AS121–AS996 belong to the additional intersections. The switching states at the output of the traffic computer Vr are transmitted by way of the output multiple Ag to the transmission channels. According to FIG. 8, this output multiple Ag comprises the outputs of a rotary preselecting time switch Dr (see FIGS. 5 and 6). The outputs of the rotary switch are connected to the contacts as111, as112, etc of the corresponding bistable elements AS111, AS112 of the traffic computer Vr. The rotary pre-selecting time switch arms, such as the arm dr1 sweep, in the cadence of the time slot pattern, the outputs as111–as116 for the intersection K11 and, parallel thereto, the corresponding outputs for the remaining intersections. If, by way of example, the third command is to be transmitted to the intersection, then the bistable element AS113 is switched on in the traffic computer; i.e. the contacts as113 in the output multiple Ag is closed. During the third step of the rotary switch the switch arm dr1 is connected to the contact as113, the transmitter $S11_1$ on the line L1 is switched on during the third time section. In turn, this is decoded at the intersection K11 (FIG. 2) as the third command. Therefore, for each intersection of the system, the output multiple Ag contains a selector arm, such as the arm dr1, with the same number of outputs. All of the selector arms dr are further connected in parallel in the cadence of the time slot pattern.

In addition, the output multiple Ag contains a time slot pattern Zr1 which is connected in the same cadence with the rotary switch selector arm dr2. This time slot pattern is coded by way of crystal diodes Ri, such that the steps of the rotary switch are available at four outputs in a two-out-of-four code. This means that, in the case of each time section, two of the four transmitters $Se^1$–$Se^4$ are switched on.

The input multiple Eg is illustrated in greater detail in FIG. 9. It serves the purpose of converting the messages arriving from the intersections in the time slot pattern into parallel data for the computer. In the present example, it contains rotary preselecting time switch selector arms dr3 which are further connected, in the same time slot pattern cadence, synchronously with the rotary pre-selecting time switch arms dr1 and dr2. In the case of a time slot pattern having six time sections, the rotary switch selector arms dr3, respectively, also sweep six outputs; each of the outputs has a message input relay ER111, ER112, etc connected thereto. By way of the respective contacts er111, er112, the respective incoming data is input into the input section E of the computer Vr. The input section E corresponds to the input section E in U.S. Pat. No. 3,375,494 (FIG. 2). There is connected to the output of each rotary switch selector arm dr3 a receiver $E21_1$, etc. This means that there are as many rotary switch selector arms dr3 as there are receivers in the central station. When an intersection delivers a specific message, the corresponding receiver in the central station always responds within the time slot pattern at a specific time section. By way of the respective rotary switch selector arm dr3, the appertaining input relay ER, just connected at this time section is switched on, and thereby transmits the message by way of the respective contact er into the computer Vr.

The aforementioned control device St only serves the purpose of establishing the connection between the outputs AS111, AS112, etc of the computer and the output multiple Ag, as well as establishing the connection between the input multiple Eg and the input section E of the computer Vr, and controlling the chronological operating sequence of these connections. This takes place by means of the time generator and the rotary switch Dr, already illustrated in FIG. 5. It is therefore not necessary to provide this structure in FIGS. 8 and 9, the same being readily apparent from FIGS. 1, 5 and 6.

The speed of the rotary switch is determined by the time generator. The rotary switch selector arms dr1 and dr2 belong to the output multiple Ag, and the rotary switch selector arms dr3 belong to the input multiple Eg.

All of the aforementioned transmitters, for example the transmitters $Se_1$–$Se_4$, S11, etc have a similar construction and each is adjusted to a different frequency. A transmitter of this type is illustrated in U.S. Pat No. 2,955,197. All of the receivers, for example the receivers E11, E21 and E29, are likewise similarly constructed and are only adjusted to a specific freqency. A receiver of this type is illustrated in U.S. Pat. No. 2,955,197 in FIG. 2.

As previously mentioned, the transmitters and receivers which are adjusted to the same frequency form a transmission channel at the central station, or at the individual station, respectively.

For other transmitters and receivers, one may refer to the publications "Transmitters TST-SH-42 and TST-SH-43", and "Receivers TST-EH-42 and TST-EH-43", both issued, in English, by Bereich Signalgeraete, September 1977, for Siemens Aktiengesellschaft.

Referring to FIG. 10, the switching device G is illustrated in greater detail. The switching device G has the purpose of converting the commands given in advance with the switching contacts b1–b6, into signal states of the traffic signals g1–g9. This takes away, by way of example, via corresponding switching relays SR1–SR6 which have respective contacts sr1, etc by way of which the traffic signal lamps are connected to an operating voltage. For example, by closing the contact b1, and, correspondingly, the contact sr1, a signal is produced in the case of which the green light is switched on in the traffic signal g1 and in the traffic signal g2, whereas the red light is switched on in the traffic signal g9. A different signal is produced by closing the contact b2, etc.

Malfunction and interference messages can be produced in the switching device G. For example, a current responsive relay C can be introduced in the circuit in series with the contact sr1 so that the relay will respond to a power failure, for example, or an inoperable lamp, and via its contact c, cause the message relay M1 to respond and transmit a failure message to the central station in the time slot pattern where the signal is evaluated as a malfunction.

A switching device of this type can also be provided in FIG. 6 between the contacts b1–b6 and the traffic signals g1, etc.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. A circuit arrangement for the transmission of signals in both directions for controlling traffic lights at a plurality of intersection installations on a time multiplex basis, said circuit arrangement comprising:

a central station and a plurality of individual stations remote from said central station for connection to and controlling the traffic lights of a plurality of traffic light intersection installations;

a plurality of transmission lines each having one end connected to said central station and another end connected to a respective individual station;

a plurality of first transmitters in said central station for each transmission line and operable in respective frequencies to transmit intersection installation identification signals;

a time slot generator in said central station connected to all of said transmission lines and operable to produce time slot pattern signals as traffic light control signals;

first receiving means in each of said individual stations connected to the respective transmission line and operable at the frequencies of said first transmitters for receiving the installation identification signals;

second receiving means in each of said individual stations connected to the respective transmission line for receiving the time slot pattern traffic light control signals;

traffic light control means connected to said first and second receiving means and adapted for connection to the traffic light installations for controlling the traffic lights in accordance with the signals received by said first and second receiving means;

means connected to said first and second receiving means for checking the orderly receipt of the traffic control signals;

a second transmitter in each of said individual stations connected to said checking means and to the respective transmission line for sending traffic signal messages indicating the received signals back to said central station; and third receiving means in said central station connected to the respective transmission lines for receiving said messages, said traffic light control means comprising a plurality of switches connected to and operated in response to the signals received by said first and second receiving means, said switches including connections for operating the traffic lights.

2. The circuit arrangement of claim 1, wherein said traffic light control means further comprises means for detecting faulty operation of the traffic lights and connected to and operable to cause said second transmitter to transmit a fault message to said central station.

3. The circuit arrangement of claim 2, wherein said means for detecting faulty operation comprises a first relay including a winding for serial connection to the powering circuit of a traffic light, and a contact, and said means for checking the orderly receipt of the traffic control signals includes a second relay which comprises a winding and a contact operated by the winding and connected to operate said second transmitter, said contact of said first relay connected to operate the winding of said second relay and cause transmission of a fault message in response to a faulty power condition of the traffic light.

* * * * *